United States Patent [19]

Hirano et al.

[11] Patent Number: 4,617,870

[45] Date of Patent: Oct. 21, 1986

[54] METHOD OF ACCELERATING RADIATIVE TRANSFER

[75] Inventors: Masahiro Hirano, Tokyo; Toshio Miyauchi, Yokohama, both of Japan

[73] Assignee: Mitsubishi Jukogyo Kabushiki Kaisha, Japan

[21] Appl. No.: 726,094

[22] Filed: Apr. 23, 1985

[30] Foreign Application Priority Data

Apr. 27, 1984 [JP] Japan ..... 59-83965

[51] Int. Cl.[4] ..... F23M 8/00

[52] U.S. Cl. ..... 110/323; 122/155 A; 122/367 R

[58] Field of Search ..... 122/367 R, 155 A; 110/323; 165/1, 185

[56] References Cited

U.S. PATENT DOCUMENTS

| | | | |
|---|---|---|---|
| 529,997 | 11/1894 | Baker | 110/323 |
| 2,153,592 | 4/1939 | Rohrer | 122/367 R |
| 4,019,466 | 4/1977 | Reed | 122/367 R |
| 4,055,165 | 10/1977 | Scragg et al. | 122/367 X |

*Primary Examiner*—Edward G. Favors

*Attorney, Agent, or Firm*—McGlew and Tuttle

[57] ABSTRACT

A method of accelerating radiative transfer is characterized in that a radiation acceleration plate is interposed between heat absorption pipe trains or planes disposed opposite to each other and heated by radiation of gases having a high temperature in a radiation portion of a furnace so that the pipes or planes are heated by radiation of the acceleration plate and radiation of the gases.

12 Claims, 11 Drawing Figures

FIG. 1-a
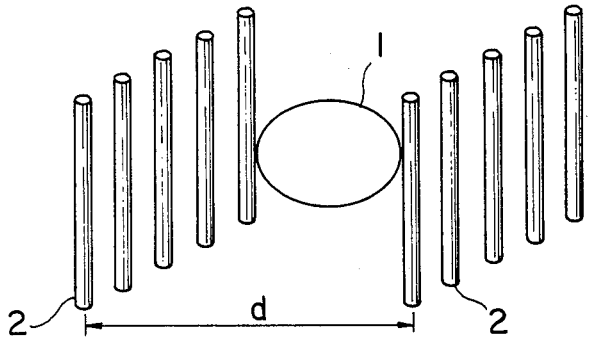
FIG. 1-b
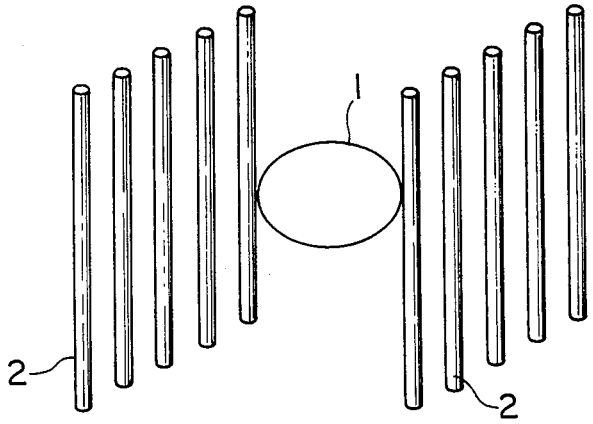
FIG. 1-c
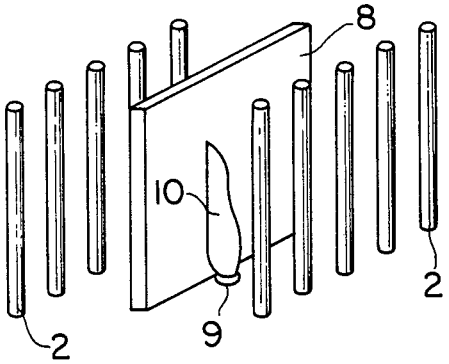

FIG. 2-a
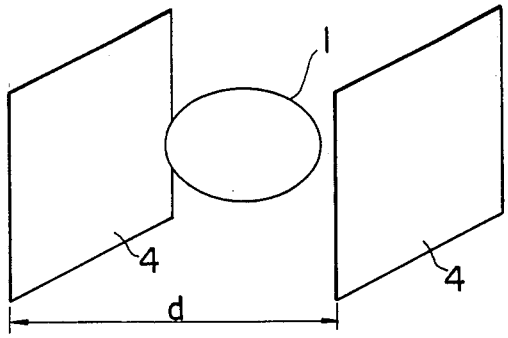
FIG. 2-b
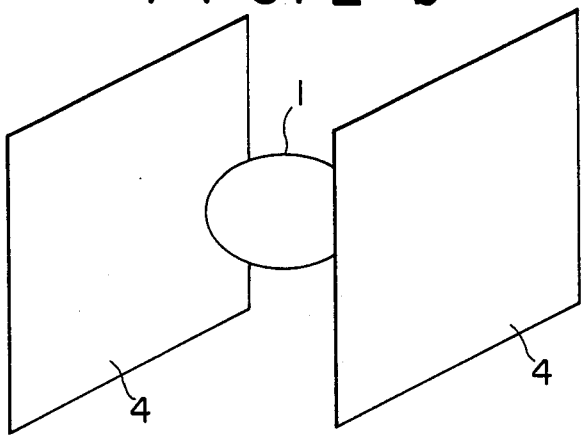
FIG. 3-a
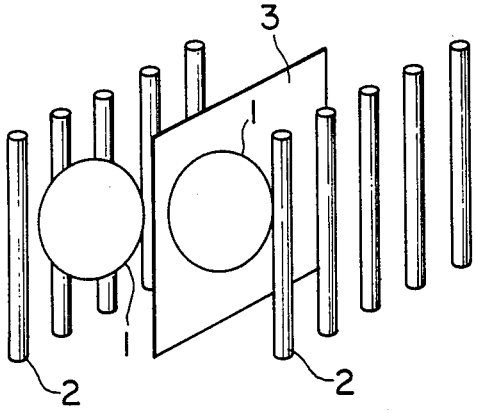

FIG. 3-b
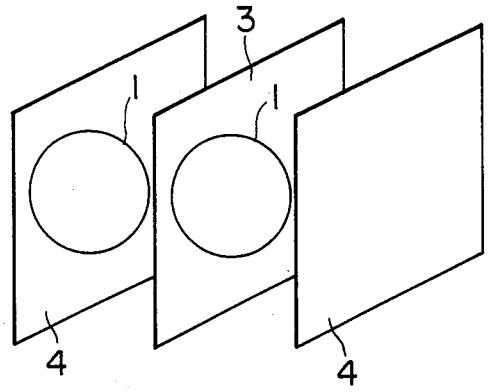
FIG. 4-a
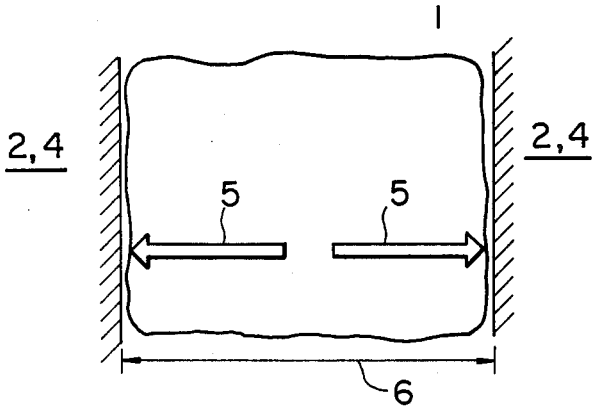
FIG. 4-b
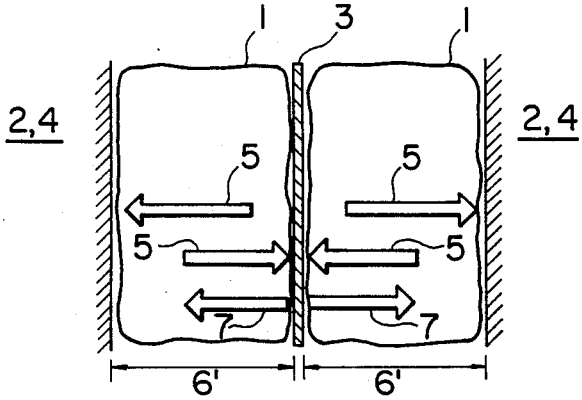

METHOD OF ACCELERATING RADIATIVE TRANSFER

FIELD OF THE INVENTION

The present invention relates to the improvement in a method of accelerating radiative transfer in a radiation portion of a furnace in which pipes or planes are heated by radiation of high temperature gases.

In such a method of accelerating radiative transfer in the prior art, as shown in FIGS. 1-*a*, 1-*b*, 2-*a* and 2-*b*, a pair of pipe groups such as heated pipes, catalytic pipes or reaction pipes (hereinafter referred to as pipes 2) or a pair of planes or plates 4 are disposed opposite to each other to put gases 1 therebetween in a radiation portion of a furnace (named a fire furnace but hereinafter referred to as a radiation portion) so that heat transfer from gases 1 is effected to the pipes 2 or the planes 4 through radiation with high efficiency. Therefore, there are the following disadvantages.

(1) In order to enhance the radiation efficiency of gases, it is required that the distance d between the pipes or the planes as shown in FIG. 1-*a* or 2-*a* is increased to thicken a gas layer therebetween. Therefore, the capacity of radiation is larger and the cost of a furnace container and the building is increased.

(2) It is required that a surface area of the pipes 2 is made larger, for example, by making longer the length of the pipes as shown in FIG. 1-*b* or a surface area of the planes 4 is increased as shown in FIG. 2-*b* because of the same reason as the above. Therefore, the cost of the pipes or planes, the furnace container and the building is increased.

Further, heretofore, as shown in FIG. 1-*c*, a high fire-resistant partition wall 8 formed of a high quality material is provided between the pipe trains 2 and the wall surface thereof is directly heated by a flame 10 of a burner 9 to a high temperature so that radiation of the solid such as the partition wall is utilized to accelerate the radiative transfer. In this case, the cost of the high fire-resistant partition wall, the furnace container (due to the increased weight of the partition wall) and the building is increased.

Japanese Patent Publication No. 7192/77 discloses the technique utilizing the radiation of the solid described above. In this prior art, a method of accelerating heat transfer is described in which there is provided in the gas flow a radiative member which is heated by convection of gases so that radiation of the member heated by convection of gases is utilized in addition to convection of gases. This technique does not require that a temperature of gases is so high (less than about 1000° C.) but is not applicable if the flow of gases is not faster than about 10 m/s (within the convective heat transfer range).

Another prior art involves an iso-flow furnace. The furnace is provided with a reflective cone above a cylindrical furnace which is directly heated by a flame to effect radiation of a solid. Accordingly, this is similar to the prior art of FIG. 1-*c*.

The present invention is to solve the drawbacks in the prior arts and provide a novel mechanism and method of accelerating radiative transfer in consideration of radiation characteristics of gases and a solid.

The method of accelerating radiative transfer according to the present invention is characterized in that a radiation acceleration plate, that is, any solid surface having high radiation efficiency (for example, a metal plate such as stainless steel and heat-resistive steel, a ceramic plate, a graphite plate or a furnace forming wall) is interposed between heat absorption pipe trains or planes disposed opposite to each other and heated by radiation of gases having a high temperature in a radiation portion of a furnace so that the radiation acceleration plate is heated by radiation of gases and the pipes or planes are heated by radiation of the acceleration plate and radiation of the gases.

According to the present invention, the capacity of the radiation portion or the surface area of the heat absorption pipes or planes is decreased without reduction of heat efficiency in the radiation portion and the partition wall for building a furnace which is formed of a high fire-resistive and high quality material and is expensive is not required so that the cost of the apparatus and the building is reduced. Further, the heat efficiency of the radiation portion is improved and the operating cost is reduced.

Particularly, the present invention is applicable to gases having the low flow velocity of about 1–5 m/s (in the radiative heat transfer control range) due to radiation of gases (combustion gases of $CO_2$ and $H_2O$) if the temperature of gases is high (more than about 800° C.).

The present invention can be widely utilized in a chemical apparatus using high temperature gases such as a reforming furnace, and the possibility of an important industrial application of the present invention can be expected.

BRIEF DESCRIPTION OF THE DRAWINGS

The above and other objects, features and advantages of the present invention will be apparent from the following detailed description in conjunction with the accompanying drawings, in which:

FIGS. 1-*a* to 2-*b* schematically illustrate a radiation portion of a furnace in the prior art, in which;

FIG. 1-*a* schematically illustrates heat absorption pipe trains disposed at a wide interval;

FIG. 1-*b* schematically illustrates heat absorption pipes having a wide surface area;

FIG. 1-*c* schematically illustrates heat absorption pipe trains having a partition wall interposed between the pipe trains and directly heated by a flame;

FIG. 2-*a* schematically illustrates heat absorption planes disposed at a wide interval; and FIG. 2-*b* schematically illustrates heat absorption planes having a wide surface area;

FIGS. 3-*a* and 3-*b* schematically illustrate a radiation portion of a furnace for use in a method of accelerating radiative transfer according to the present invention, in which;

FIG. 3-*a* schematically illustrates heat absorption pipe trains having a radiation acceleration plate interposed between the pipe trains; and FIG. 3-*b* schematically illustrates heat absorption planes having a radiation acceleration plate interposed between the planes;

FIG. 4-*a* is a view illustrating an operation of a radiation portion of a furnace in which the radiation acceleration plate is not disposed;

FIG. 4-*b* is a view illustrating an operation of a radiation portion of a furnace in which the radiation acceleration plate is disposed;

PREFERRED EMBODIMENTS OF THE INVENTION

Figure 5:
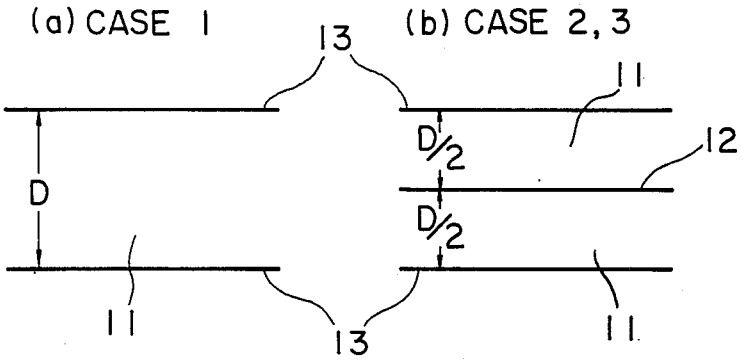
FIG. 5 illustrates a model of the heat absorption planes opposite to combustion gases of the radiation portion.

The present invention will now be described in detail with reference to embodiments shown in the drawings, in which the like numerals to those described above in the prior art designate the like or equivalent elements.

Referring now to FIG. 3-*a*, a radiation acceleration plate 3 is inserted between the pipe trains of heat absorption pipes 2 in the radiation portion of the furnace and a mass of gases 1 is interposed between the pipes trains. The plate 3 forms any solid surface with high radiation efficiency and is formed of a metal plate such as stainless steel and heat-resistive steel, a ceramic plate, a graphite plate or a furnace building wall.

Further, referring to FIG. 3-*b*, the radiation acceleration plate 3 is inserted between a pair of heat absorption planes 4,4 and a mass of gases 1 is put between the planes 4.

However, the radiation acceleration plate 3 is not heated directly by a flame.

Description will now be made to the operation of the method of accelerating radiative transfer in which the radiation acceleration plate 3 is inserted.

Referring to FIG. 4-*a*, when a flowing velocity of gases 1 having a high temperature and interposed between the pipe trains of pipes 2 or the planes 4 opposite to each other is slow and the radiation acceleration plate 3 is not inserted, heat transfer to the surface of the pipes 2 or the planes 4 is mainly effected by radiation 5 of gases.

When the plate 3 is inserted as shown in FIG. 4-*b*, the mass of gases 1 is divided into two by the plate 3 and the thickness of the gas layer is reduced to a thickness 6' as compared with the thickness 6 in FIG. 4-*a* so that the radiation efficiency of the gases 1 is reduced and heat transfer by radiation of the gases 1 to the surface of the pipes 2 or the planes 4 is also reduced, but the reduction thereof is non-linear and not great (that is, not proportional to the thickness 6, 6' of the gases).

On the other hand, the inserted plate 3 is heated by radiation 5 of gases so that the plate 3 emits radiation 7 to heat the surface of the pipes 2 or the planes 4 opposite to the plate 3.

Accordingly, in the case of FIG. 4-*b*, the surface of the pipes 2 or the planes 4 is heated by radiation 5 of the gases 1 and radiation 7 of the plate 3 and an amount of heat transfer thereof is larger than that by only the radiation 5 from the gases 1 when the plate 3 is not inserted, so that heat transfer by radiation is accelerated.

The prior art in which the partition wall is directly heated by flame as shown in FIG. 1-*c* or the above-mentioned iso-flow furnace is different in the principle from the present invention in that a mechanism of radiation 5 by gases to the plate 3 shown in FIG. 4-*b* is replaced by a mechanism of direct heat transfer of convention by flame. The radiation acceleration plate of the present invention is not directly heated by flame and therefore high heat-resistance is not required.

Further, the prior art disclosed in the above mentioned Japanese Patent Publication No. 7192/77 is also different in the principle from the present invention in that the mechanism of radiation 5 by gases to the plate 3 shown in FIG. 4-*b* is replaced by the mechanism of forced heat transfer of convection by gases flowing at a high speed.

As described above, according to the method of accelerating radiative transfer of the present invention, a radiation acceleration plate is interposed between heat absorption pipe trains or planes disposed opposite to each other and heated by radiation of gases having a high temperature in a radiation portion of a furnace so that the radiation acceleration plate is heated by radiation of gases and the pipes or planes are heated by radiation of the acceleration plate and radiation of the gases. Accordingly, the following effects are attained.

(1) Since an amount of radiative transfer per a unit surface area of the pipes or the planes is increased by the radiative transfer acceleration effect of the plate as compared with the condition in which the plate is not inserted, the surface area of the pipes or the planes required to obtain the necessary total amount of heat to be absorbed can be reduced without loss of the heat efficiency in the radiation portion.

(2) Since the necessary total amount of heat to be absorbed can be obtained without loss of the heat efficiency in the radiation portion even if the distance between the pipes or the planes is narrowed and the thickness of the gases layer is made small as compared with the condition in which the plate is not inserted, the capacity of the radiation portion can be reduced.

(3) The heat efficiency of the radiation portion can be improved as compared with the condition in which the plate is not inserted.

[SIMULATION EXAMPLE 1]

In order to confirm the effect of compactness of the furnace by the radiation acceleration plate (the reduction effects in the above items 1 and 2), a model simulation has been made as follows.

(1) Summary of Model

As shown in FIGS. 5(*a*) and (*b*), combustion gases 11 forming a mass of gases having a high temperature in the radiation portion and the opposite heat absorption planes are modeled. In other words, in the furnace having the heat absorption pipes, one train of pipes is modeled by one infinitely extending equivalent plate 13, and the comparison is made for the case where the radiation acceleration plate is inserted and the case where the plate is not inserted.

(2) Precondition (1) The composition of combustion gases 11 is $$CO_2/H_2O/N_2/O_2 = 8/16/73/3 \text{ vol } \%.$$

(2) The pressure of combustion gases 11 is 1 atmosphere.

(3) Gases are uniformly mixed and the temperature thereof is uniform.

(4) The plates 12 and 13 are each of black body and extend infinitely ($\epsilon = 1$).

(5) There is an assumption that heat transfer on the basis of convention and conduction from gases 11 to the plates 12 and 13 is not effected.

(3) Calculation Manner

Case 1: The case where the radiation acceleration plate 12 is not inserted and only the plates 13 exist. The heat flux $q_1$ of radiation to the plates 13 is calculated.

Case 2: The case where the plate 12 is inserted. The heat flux $q'_1$ ($>q_1$) of radiation to the plates 13 is calculated.

Case 3: The case where the plate 12 is inserted. The distance between the plates 13 necessary to obtain the same heat flux of radiation as the heat flux $q_1$ obtained in the case 1 is calculated.

The area reduction effect in the heat transfer and the capacity reduction effect in the radiation portion in the cases 2 and 3 are calculated on the basis of the following equations.

$$\text{Area reduction effect} = (1 - q_1/q'_1) \times 100\ (\%)$$

$$\text{Capacity reduction effect} = (1 - D'/D) \times 100\ (\%)$$

(4) Calculation Results

The calculation results are shown in Tables 1 to 3.

TABLE 1

| Case No. | Gas Temperature Tg (°C.) | Heat Absorption Plane Temp. $Tw_1$ (°C.) | Distance Between Planes D (m) | Heat Flux Supplied To Heat Absorption Plane $q_1$ (kcal/m²h) | Reduction Effect of Heat Transfer Area (%) | Reduction Effect of Radiation Portion Capacity (%) |
|---|---|---|---|---|---|---|
| 1 | 1700 | 870 | 3 | 147,000 | | |
| 2 | | | 3 | 180,000 | 18 | |
| 3 | | | 2.0 | 147,000 | | 33 |
| 1 | | | 1 | 82,700 | | |
| 2 | | | 1 | 109,000 | 24 | |
| 3 | | | 0.48 | 82,400 | | 52 |
| 1 | | | 0.2 | 40,400 | | |
| 2 | | | 0.2 | 49,900 | 19 | |
| 3 | | | 0.15 | 40,300 | | 25 |
| 1 | | | 0.1 | 26,000 | | |
| 2 | | | 0.1 | 30,500 | 15 | |
| 1 | 1350 | 870 | 3 | 71,200 | | |
| 2 | | | 3 | 90,300 | 22 | |
| 3 | | | 1.7 | 71,900 | | 43 |
| 1 | | | 1 | 43,000 | | |
| 2 | | | 1 | 57,300 | 25 | |
| 3 | | | 0.48 | 43,200 | | 52 |
| 1 | | | 0.2 | 21,200 | | |
| 2 | | | 0.2 | 27,000 | 21 | |
| 3 | | | 0.14 | 21,200 | | 30 |
| 1 | | | 0.1 | 14,100 | | |
| 2 | | | 0.1 | 17,100 | 18 | |
| 1 | 1000 | 870 | 3 | 15,200 | | |
| 2 | | | 3 | 19,800 | 23 | |
| 3 | | | 1.6 | 15,200 | | 47 |
| 1 | | | 1 | 9,330 | | |
| 2 | | | 1 | 12,900 | 28 | |
| 3 | | | 0.42 | 9,460 | | 58 |
| 1 | | | 0.1 | 3,340 | | |
| 2 | | | 0.1 | 4,220 | 21 | |
| 3 | | | 0.070 | 3,320 | | 30 |

TABLE 2

| Case No. | Gas Temperature Tg (°C.) | Heat Absorption Plane Temp. $Tw_1$ (°C.) | Distance Between Planes D (m) | Heat Flux Supplied To Heat Absorption Plane $q_1$ (kcal/m²h) | Reduction Effect of Heat Transfer Area (%) | Reduction Effect of Radiation Portion Capacity (%) |
|---|---|---|---|---|---|---|
| 1 | 1350 | 500 | 3 | 101,000 | | |
| 2 | | | 3 | 125,000 | 19 | |
| 3 | | | 1.8 | 100,300 | | 40 |
| 1 | | | 1 | 61,900 | | |
| 2 | | | 1 | 80,900 | 23 | |
| 3 | | | 0.48 | 61,500 | | 52 |
| 1 | | | 0.2 | 31,100 | | |
| 2 | | | 0.2 | 39,200 | 21 | |
| 3 | | | 0.14 | 31,200 | | 30 |
| 1 | | | 0.1 | 20,800 | | |
| 2 | | | 0.1 | 25,200 | 17 | |
| 1 | 1000 | 500 | 3 | 43,000 | | |
| 2 | | | 3 | 53,600 | 20 | |
| 3 | | | 1.7 | 43,000 | | 43 |
| 1 | | | 1 | 27,400 | | |
| 2 | | | 1 | 36,700 | 25 | |
| 3 | | | 0.42 | 27,300 | | 58 |
| 1 | | | 0.1 | 10,100 | | |
| 2 | | | 0.1 | 12,600 | 20 | |
| 3 | | | 0.072 | 10,200 | | 28 |
| 1 | 1000 | 200 | 3 | 51,500 | | |
| 2 | | | 3 | 63,100 | 18 | |
| 3 | | | 1.7 | 51,600 | | 43 |
| 1 | | | 1 | 33,300 | | |
| 2 | | | 1 | 43,800 | 24 | |
| 3 | | | 0.46 | 33,500 | | 54 |

TABLE 2-continued

| Case No. | Gas Temperature Tg (°C.) | Heat Absorption Plane Temp. $Tw_1$ (°C.) | Distance Between Planes D (m) | Heat Flux Supplied To Heat Absorption Plane $q_1$ (kcal/m$^2$h) | Reduction Effect of Heat Transfer Area (%) | Reduction Effect of Radiation Portion Capacity (%) |
|---|---|---|---|---|---|---|
| 1 | | | 0.1 | 12,200 | | |
| 2 | | | 0.1 | 15,100 | 19 | |
| 3 | | | 0.070 | 12,100 | | 30 |

TABLE 3

| Case No. | Gas Temperature Tg (°C.) | Heat Absorption Plane Temp. $Tw_1$ (°C.) | Distance Between Planes D (m) | Heat Flux Supplied To Heat Absorption Plane $q_1$ (kcal/m$^2$h) | Reduction Effect of Heat Transfer Area (%) | Reduction Effect of Radiation Portion Capacity (%) |
|---|---|---|---|---|---|---|
| 1 | 800 | 200 | 3 | 28,400 | | |
| 2 | | | 3 | 35,000 | 19 | |
| 3 | | | 1.5 | 28,400 | | 50 |
| 1 | | | 1 | 19,100 | | |
| 2 | | | 1 | 25,200 | 24 | |
| 3 | | | 0.44 | 19,200 | | 56 |
| 1 | | | 0.1 | 7,240 | | |
| 2 | | | 0.1 | 9,050 | 20 | |
| 3 | | | 0.070 | 7,300 | | 30 |

[SIMULATION EXAMPLE 2]

In order to confirm the efficiency improvement effect and the efficiency maintenance effect of the furnace by the radiation acceleration plate, a model simulation has been made as follows.

(1) Summary of Model

Figure 6:
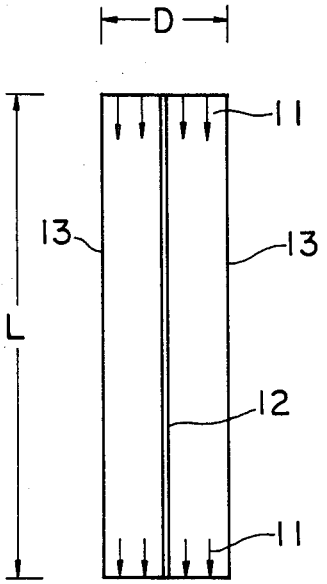
FIG. 6 illustrates a model of the radiation portion of the furnace.

The radiation portion (fire furnace) of the furnace is modeled as shown in FIG. 6.

In other words, each train of the heat absorption pipe trains disposed opposite to each other to interpose the combustion gases 11 therebetween is modeled by one equivalent plate 13 and the radiation acceleration plate is interposed between the plates 13.

(2) Precondition (1) The composition of combustion gases 11 is $$CO_2/H_2O/N_2/O_2=8/16/73/3 \text{ vol \%}.$$

(2) The pressure of combustion gases 11 is 1 atmosphere.

(3) The plates 12 and 13 are each of black body and extend in the direction of depth infinitely.

(4) The temperature at an inlet for the gases 11 is 1750° C. and the amount of flowing gases is 2600 kg/mh (the amount of flowing gases per unit depth). (fuel consumption $1.441\times10^6$ kcal/mh)

(5) The temperature of the plate 13 is a constant temperature of 870° C.

(3) Calculation Results

The calculation results are shown in Table 4.

TABLE 4

| Case | Means for Making Small Furnace | D (m) | L (m) | Reduction Ratio of Heat Transfer Area (%) | Reduction Ratio of Radiation Portion Capacity (%) | Heat Absorption Amount of Radiation Portion (Fire Furnace) ($10^3$ kcal/mh) | Thermal Efficiency of Radiation Portion (Fire Furnance) (%) |
|---|---|---|---|---|---|---|---|
| Original (Before Insertion of Radiation Acceleration Plate) | — | 2 | 10 | — | — | 710 | 49.8 |
| After Insertion of Radiation Acceleration Plate | — | 2 | 10 | — | — | 730 | 51.2 |
| | Reduction of Heat Transfer Area | 2 | 8 | 20 | — | 710 | 49.8 |
| | Reduction of Radiation Portion Capacity | 1 | 10 | — | 50 | 710 | 49.8 |

From foregoing, the above-mentioned effects (1), (2) and (3) could be confirmed. Accordingly, the cost of the apparatus, the building and the operation of the furnace can be reduced.

What is claimed is:

1. A method of accelerating radiative transfer, characterized in that a radiation acceleration plate is interposed between heat absorption pipe trains or planes disposed opposite to each other and heated by radiation of gases having a high temperature in a radiation portion of a furnace so that the pipes or planes are heated by radiation of the acceleration plate and radiation of the gases.

2. A method according to claim 1, wherein said radiation acceleration plate is formed of a metal plate such as stainless steel, heat-resistive steel, a ceramic plate, a graphite plate, a furnace building wall or the like and contains any solid surface having high radiation efficiency.

3. Method of claim 1, wherein the gases have a flow velocity in the radiative heat transfer control range.

4. Method of accelerating radiative transfer of heat from gases having a high temperature in a furnace having a radiation portion in which such gases have a flow velocity in the radiative heat transfer control range, characterized in that a radiation acceleration plate is interposed in such radiation portion of the furnace and between heat absorption pipe trains or planes disposed opposite to each other therein and sufficiently for the radiation acceleration plate to be heated by radiation of such gases having a high temperature in said radiation portion of the furnace so that such radiation acceleration plate is heat by radiation of said gases and in turn such pipe trains or planes are heated both by radiation emitted by the acceleration plate and by radiation of said gases.

5. Method of claim 4, wherein said radiation acceleration plate is in the form of a solid surface containing plate having high radiation efficiency.

6. Method of claim 4, wherein said gases have a low flow velocity of about 1–5 m/s.

7. Method of claim 4, wherein said gases have a temperature of more than about 800° C.

8. Method of claim 4, wherein said gases have a low flow velocity of about 1–5 m/s and a temperature of more than about 800° C.

9. Method of claim 4, wherein said gases are $C0_2$ and $H_2O$ containing combustion gases.

10. Method of claim 4, wherein the furnace has a flame and the flame and radiation acceleration plate are positioned relative to each other such that the radiation acceleration plate is not heated directly by the flame.

11. In a furnace having a radiation portion for hot gases having a flow velocity in the radiative heat transfer control range, the improvement for accelerating radiative transfer of heat from such hot gases which comprises providing an arrangement in such radiation portion including heat absorption pipe trains or planes disposed opposite to each other and a radiation acceleration plate interposed between the oppositely disposed pipe trains or planes so that the radiation acceleration plate is heated by radiation of the hot gases in the radiation portion of the furnace and the pipe trains or planes are heated by radiation of the acceleration plate and by radiation of the gases.

12. Improvement of claim 11, wherein said radiation acceleration plate is in the form of a solid surface containing plate having high radiation efficiency.

* * * * *